US008110070B2

(12) United States Patent
Grass

(10) Patent No.: US 8,110,070 B2
(45) Date of Patent: Feb. 7, 2012

(54) PRODUCTION OF NON-WOVEN ELEMENTS MADE OF NATURAL FIBRES

(76) Inventor: Stefan Grass, Illnau (CH)

( * ) Notice: Subject to any disclaimer, the term of this patent is extended or adjusted under 35 U.S.C. 154(b) by 0 days.

(21) Appl. No.: 12/596,255

(22) PCT Filed: Mar. 25, 2008

(86) PCT No.: PCT/CH2008/000131

§ 371 (c)(1),
(2), (4) Date: Oct. 23, 2009

(87) PCT Pub. No.: WO2008/116340

PCT Pub. Date: Oct. 2, 2008

(65) Prior Publication Data

US 2010/0147474 A1 Jun. 17, 2010

(30) Foreign Application Priority Data

Mar. 26, 2007 (CH) ..... 482/07

(51) Int. Cl.
*D21F 11/00* (2006.01)

(52) U.S. Cl. ..... 162/141

(58) Field of Classification Search ..... 162/141; 156/62.2; 264/103, 282, 136
See application file for complete search history.

(56) References Cited

U.S. PATENT DOCUMENTS

2007/0044891 A1 3/2007 Sellars

FOREIGN PATENT DOCUMENTS

| | | | |
|---|---|---|---|
| AT | 41 12 270 | B | 11/2003 |
| DE | 200 23 167 | U1 | 6/2003 |
| FR | 2 294 648 | | 7/1976 |
| FR | 2 765 773 | A1 | 1/1999 |
| WO | 2005/017251 | A1 | 2/2005 |

*Primary Examiner* — Mark Halpern
(74) *Attorney, Agent, or Firm* — Davis & Bujold, P.L.L.C.

(57) ABSTRACT

A method of producing non-woven elements made from a raw material comprising grass plants. A first intermediate product is made of per-prepared, damp natural fibers having a dry substance concentration of between 30%-50%, more preferably approximately 40%. The invention also relates to the production of a second intermediate product from the first intermediate product according to the following steps. The natural fibers are predried, thermoactive binding fibers are added thereto, additives are sprayed thereon and the order of the step can vary and/or individual steps may be carried out simultaneously with one another. Preferably, the raw material is silated grass and, in order to produce the first intermediate product, the raw material is defibered and the digestible components of the raw material are separated therefrom.

18 Claims, 2 Drawing Sheets

PRODUCTION OF NON-WOVEN ELEMENTS MADE OF NATURAL FIBRES

This application is a 371 of PCT/CH08/00131 filed on 25 Mar. 2008.

The invention concerns the field of manufacture of non-woven fleece elements, especially for the use in temperature isolation or sound isolation elements. It relates to a method and a machinery system for the manufacture of insulating elements from natural fibers, as well as concerning an isolation element according to the meaning of the related claims.

STATE OF THE ART

The manufacturing of fiber fleece, from synthetic fibers, by adding retaining fibers has been used in industrial applications for decades. The manufacture of insulating panels from wood, flax, or hemp fibers, by using retaining fibers, is also known. Such concept of manufacture is, for instance, known by DE 200 23 176 U1: wooden fibers or hemp fibers are mixed with retaining fibers, based on synthetic fibers, and bonded together by heating.

US 2007/0044891 describes the manufacture of a fiber fleece for the production of paper towels, cleaning towels, etc., a mixture of pulp, combined with binding fiber and perhaps additional additives, and a fleece will be generated in a dry process. The fleece can be dried further, be treated with steam, or with additional matter, and is bonded together with binding fibers by heating or melting.

Prior to the fleece spreading, the pulp can be prepared in a wet method, to performing a de-bonding of the fiber. Later, the pulp mixture will be dried again, i.e., to add the binding fiber.

The processing of grass is the subject of several patent applications: FR-a-2294648 teaches the mechanical de-hydration of lucerne and grass, followed by the drying of the pressed, mixed matter, to manufacture food cubes. WO 2005/017251 explains the de-fibering of grass to manufacture a fiber based matter. None of the publications relates to fiber fleeces which have been produced from grass fiber, and have been bonded with retaining fibers in a three dimensional process.

DESCRIPTION OF THE INVENTION

It is the purpose of the invention to present a process and a machinery system for the manufacture of fleece elements from natural fibers, as mentioned previously in a state of the art, which offer considerable, improved specifications over the known state of the art with regard to non-woven fleece elements.

The task is solved by a process and a machinery system for the manufacture of fleece elements, as in the previously mentioned art, which demonstrates improvements over the fleece elements currently known in the art.

This task is solved by a method and a machinery system for the manufacture of fleece elements from natural fibers, as well as a fleece element with the features as outlined in the related claims.

In this inventive method, the basis is grass plants. A first intermediate product comprises preprocessed, moist, natural fibers which have a dry substance component of 30% to 50%, preferably nearly 40%. For the manufacture of a second intermediate product, derived from the first intermediate product, the following steps are taken:

pre-dry of the natural fibers, adding a mix of thermo active binding fibers, spray on additives, whereby the sequence of these steps can be different and/or single steps can be performed jointly.

Therefore, the first intermediate product comprises prefabricated grass fibers, also here called natural fibers or plant fibers. The second intermediate product is a mixture of these natural fibers with binding fibers and additives such that the mixture hereafter can be used for the manufacture of fleece.

The term "grass" includes all known kinds of grass (family of the graminace), including grain such as wheat, barley, oat, rye, sorghum, as well as sugar cane and corn. The raw material is harvested, while still green, and temporarily stored, year round and independent of weather, in the form of silage. Also included in the term "grass" is the residue from the processing of sweet sorghum as well as sugar cane which, among experts, is called bagasse.

The term "binding fibers" includes fibers which are activated on a thermal basis and which, when mixed with natural fibers, provide these with a fixed, three dimensional structure. Hereby, they can be fusible fibers made out of polypropylene, or polyethylene, can be recycled plastic or bico (bi-component) fibers with a fusible mantle and a more durable temperature core component. Binding fibers also include fibers, i.e., made from starch or lactic acid and are biologically degradable. These fibers are called, by experts, supporting fibers. In a preferred embodiment of the invention, the binding fiber represents 4% up to 20% by weight, preferably 5% to 15% or up to 10%. The portion of the binding fibers can be reduced through the inventive methods, therefore, also the cost can be reduced.

The term "fleece elements" indicates three dimensional, flexible, or rigid mats made from a nonwoven fleece, in other words, made from a structure of bonded fibers. The fleece elements can be flexible or rigid, have different thicknesses or density, and are used for different applications. They are including the following applications:

As an insulation to protect from cold, heat and sound,

In automotive to manufacture the interior trim,

For mattresses,

As ground cover and/or growing medium in agriculture,

Similar (i.e. orthotics, . . . ).

The isolation elements preferably have the following dimensions and grammages:

Isolation mats with the density of 30-50 kg/m$^3$ and thickness of 50-250 mm:

Grammage 1.5-12.5 kg/m$^2$, preferably 3-10 kg/m$^2$,

Stairway noise insulation and façade panels having a density of 90-120 kg/m$^3$ and a thickness of 10-100 mm:

Grammage 0.9-12 kg/m$^2$, preferably 2-10 kg/m$^2$.

The addition of binding fibers to the mixture preferably takes place before bringing in additives (i.e., flame retardants and biocides) so that the binding fibers are also treated with the additives.

The addition of the binding fibers to the mixture can take place under the different grades of the natural fibers humidity level of the first intermediate product. In a preferred embodiment of the invention, the addition to the mixture takes place with the natural fibers' dry content of more than approx. 85%. That requires a pre-drying of the natural fibers prior to performing the mixing.

In another preferred embodiment of this invention, the mixing takes place with a natural fibers dry matter content of around 40% up to around 85%. Depending on how large the content of the dry matter of the first interim product, a pre-drying does not take place before the mixing, but solely after or during the mixing process.

A fixture for executing a core function of this application, meaning the pre-drying, the mixing and adding of binding fibers, and spraying on additives, preferably comprises of a standing container which is loaded, from the top, with mist natural fibers and with binding fibers and in which hot air is blown in from the bottom. The two types of fibers are swirled and mixed in that container, via the stream of hot air, and are removed from the container via an extraction nozzle and a pipe. Hereby, the two types of fibers are pre-dried. The pipe has built-in spray equipment which allows the uniform spraying of the additives, but also is not in the way of the outflow of the matter. The container can be configured to have a propeller, rotating around a vertical axis, to support the swirling and/or the flow of hot air.

In another preferred embodiment of this invention, the adding of the mixture takes place via a watery suspension, meaning a dry substance content of under approx. 10%. Therefore, the requirements for the draining, through a preprocessing to manufacture the first intermediate product, are relatively small. The pre-drying of the suspension, after the preferably mechanically mixing takes place, is optionally coupled with an air drying method.

In the case of pre-drying by hot air, during or after adding the mixing of the binding fibers, the drying air temperature will be kept below the temperature needed to activate the binding fibers. Preferably, the hot air temperature is set within the range of 80° C. and 200° C. Preferably, the pre-drying takes place in a conveying section, in which the fibers are advanced by hot air.

The second intermediate product therefore comprises a mixture of natural fibers and binding fibers, with a binding fiber content of 4% to 20%, preferably 5% to 15%, or to 10%, is equipped with additives, and further comprises a dry substance content of preferably 40% to 75%. Naturally, the dry substance content is heavily dependent on how much liquid is added via the spraying of the additives, and also if pre-drying will take place after spraying.

The manufacture of the first intermediate product, meaning the preprocessed plant fibers, preferably takes place by de-fibering the raw material and by separating the digestible content from the raw material. In particular, the digestible components are lactic acid, acetic acid, amino acid, proteins and minerals.

The raw material, in a further preferred variation of the invention, comprises grassilage (silage grass) preferably having a dry substance content of 20% to 40%, in particular 25% to 35%. In another preferred variation of this invention, the raw material comprises golden oat-grass (*trisetum flavescens*).

The de-fibering, however, preferably takes place in a watery solution comprising a macerator and/or a deflaker device, optionally equipped with a front-end device for tearing up the raw material, as an example, a hammer mill or a silo removal milling device. When a macerator is used in combination with a deflaker device, the macerator is positioned in front, followed by the deflaker device.

After the de-fibering, the separation of the digestible parts preferably takes place through the separation of the fibers from the solution, whereby the digestible parts remain in the solution.

The digestible components are preferably processed, by a separate branch of the processing, into feeding stuff or into food additives. This takes place through a concentration process of the content in the solution to a food, whereby the water content is preferably recycled.

The digestible parts preferably comprise organic acid, proteins and minerals, in addition preferably also enzymes, vitamins, and parts similar to hormones, especially a vitamin D3-hormone. The presence of these materials depends on the selection of the raw material, meaning from the selection of the plants and the optional silage tools.

When manufacturing the nonwoven fleece from the second intermediate product, meaning from the finished conditioned fiber mix, preferably the fleece is generated and binding fibers are activated so that these are bind together and create a matrix. The creation of the nonwoven fleece takes place by providing in the second intermediate product with a dry substance content of approx. 60% to 85% or higher, and which is directly used to creating the nonwoven fleece whereby, and if necessary, a final drying during the heating of the nonwoven fleece takes place for activating the binding fibers. As an alternative, the creation of the nonwoven fleece takes place by having a dry substance content of 40% to approx. 60% in the second intermediate product, laying it on a conveyor belt, undergoing drying via hot air, and optionally being loosened up, followed by heating for the activation of the binding fibers.

The production of the nonwoven fleece, and the possible additional steps of drying and activation, preferably takes place in a continuous process to produce a fleece tape. From that fleece tape, fleece elements are cut. Alternatively, the fleece creation, etc., takes place in a batch operation in which single fleece elements are produced in dedicated molds.

In summary, the method in this invention comprises, in a preferred embodiment, the following steps:

(a) The raw material grass will be compressed, when in a moist state, and sealed airtight. For a long time this method in known in the agriculture field area as "silaging."

(b) The silage grass is conditioned for further processing, meaning in a way so that the manufacture of a suspension, which can be guided or pumped, is possible.

The conditioned raw material is de-fibered and mostly freed from digestible matter.

The grass fibers are drained, mixed with binding fibers, equipped with additives, and prepared for fleece laying.

A three dimensional nonwoven fleece is produced and thermally stabilized from the prepared mixture of fibers.

Therefore, the invention is enabling:

The providing of the raw material, for a year round use, having a consistent quality.

The manufacture of grass fibers deriving from this raw material.

The processing of the grass fibers into a three dimensional, stable fleece material or insulation material, respectively.

Additional preferred embodiments are listed in the claims. Hereby, the characteristics and features of the claims are combined with the fixture claims, and vice versa.

BRIEF DESCRIPTION OF THE DRAWINGS

In the following, the inventive subject is presented, through the preferred embodiments, as shown in the drawings.

ENABLEMENT AND EXECTION OF THE INVENTION

Figure 1:
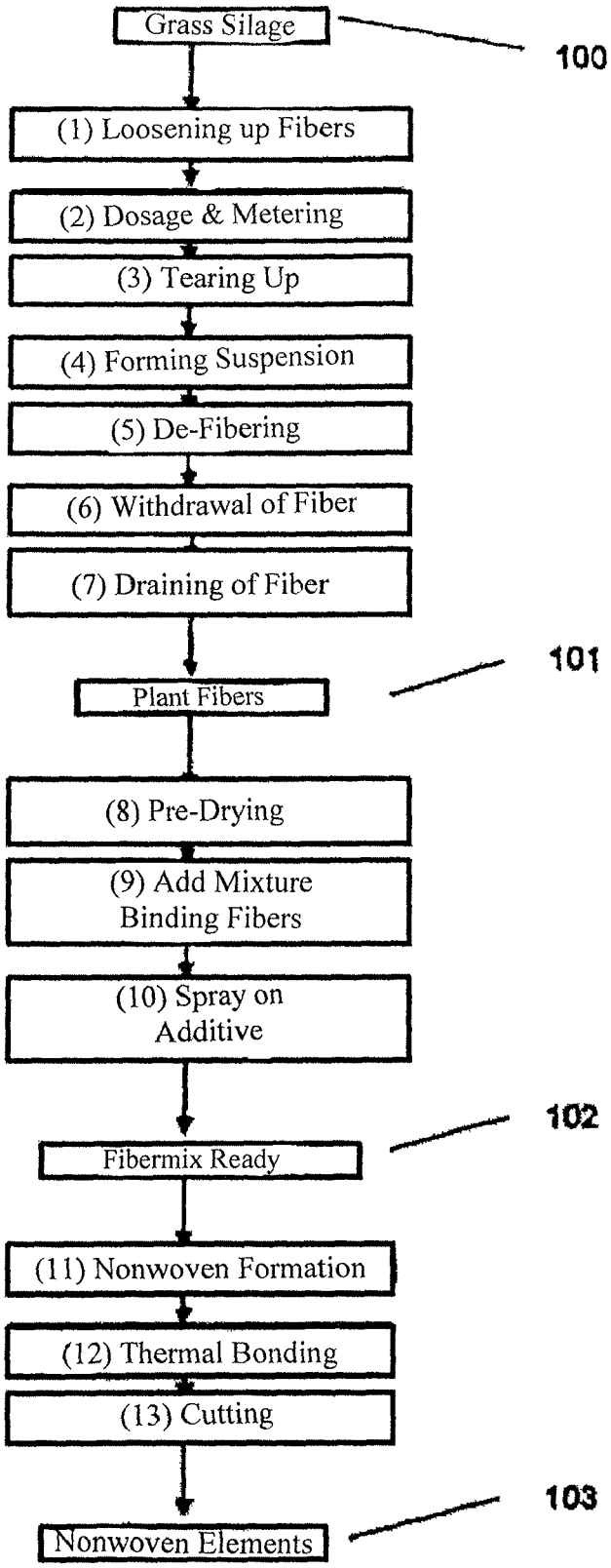
FIG. 1 shows the schematic method flow.

In the following, a nonwoven fleece manufacturing is described, as in FIG. 1, starting with the production of the raw material. First, the raw material grass is mowed in the field. Hereby, preferably the grass will be processed together with a conditioner, which opens the stalk structure in a way so that they become soft and increase the lose of moisture. The mowed grass is withered in the field meaning to pre-dry the grass to a dry substance content of 25-40%. Thereafter, it is being collected and pressed in a silo under the exclusion of air, or silated, respectively. That way, the raw material is stored without loss, for a long time, and is available at any time for processing and also independent of weather conditions. The silage preferably takes place in large, horizontal, moving silos, but also takes place through bales of silage or in standing silos. Optionally, silage support matter is added as well.

For the processing, the raw material is cut off from the silo, being loosened 1 and moved to a metering device 2. The device moves the raw material into one or more hammer mills, where it is ripped apart 3 and reduced into parts of an approx. 10-30 mm in length and 1-3 mm in thickness. Thereby, the plant parts are prepared for the de-fibering which follows.

By using the de-fibered plant matter and adding water, a raw material suspension, which can be stirred or pumped, is manufactured 4. The raw material suspension is moved to a mechanical de-fibering 5. The de-fibering is accomplished through de-fibering assembly which has successfully been used for decades in the pulp industry, i.e., deflakers (defibrator), macerators, or refiners. To optimize the de-fibering process in view of fiber length and fiber thickness, the de-fibering assemblies are also configured for series operation. Results have shown that the combination and sequence of a macerator and a deflaker is well suited for this particular task. In this sequence, the macerator is able to provide the suction of the raw material suspension by itself as well as the charging of the following deflaker, takes over the additional homogenization of the raw material suspension. Hereby, fibers of a predominant length of 3-30 mm and approx. 0.05-0.5 mm thickness are produced. During the de-fibering of the fibers, a higher volume transfer of soluble and digestible content of the raw material takes place into the liquid phase. The de-fibering takes place independently of the temperature. However, it has been demonstrated that a temperature of over 40° C. offers advantages with regard to the fiber processing ability, the achieved quality of the fiber, and cleaning of the fiber.

After the de-fibering, the fibers are being mechanically drained 7. This is preferably done by the withdrawal 6 of fibers from the suspension, followed by pressing the fibers in a screw press. The withdrawal from the suspension preferably takes place via a screen, i.e., a curved screen or a drum screen. Via the screw press, for instance, the fiber mixture is drained to a dry substance content level of approx. 36-46%. The soluble and digestible raw material parts in the suspension mainly comprises organic acids (lactic acid, acetic acid, amino acids), not fermented sugars, proteins, or minerals. By adding useful silage agents, i.e., bacterial cultures, the conversion of the fermentable sugar, residing in the raw material, is handled on a controlled basis. For instance, a certain ratio of lactic acid and acetic acid is accomplished.

The soluble and digestible parts in the raw material are concentrated, after the separation from the fibers, and used as feeding stuff. It is important to stress the value of such special feeding stuff is the acid matter, as a carrier of the flavor, and is the food stuff itself. In addition, depending on the kind of grass used, valuable enzymes, vitamins, or similar hormone substances might be present in that stream of matter. An example here is the use of the grass kind called golden oat grass (*trisetum flavescens*), containing a vitamin D3-derivative, being partially water soluble and supporting the bone augmentation of mammals and humans.

All listed ingredients and specifications are not only being used for feeding animals, but also are used as additive to human nutrition. The necessary concentration of the ingredients takes place through filtration and/or evaporation. It should be noted that the mineral matter, during the concentration process, might be lost from the solution.

In the following, the further processing is described. During the following steps, the drying or pre-drying 8 takes place, the adding 9 of binding fibers, as well as the treatment 10 of the fibers with additives.

For the adding 9 of the binding fibers, the industry offers continuous processes, as well as charge processes, which are well suited. When processing the grass fibers, the adding of binding fibers takes place with a content by weight of 4-25%, preferably 5-15% of the product's weight.

The treatment 10 of the fibers with additives takes place via spraying the loose fibers. To ensuring the best possible consistent layer of the additives, the spaying takes place in an air flow in which the fibers are moving freely. The spaying is accomplished with flame retardants, for instance with borates or an ammonium compound as well as with a hydrophobic agent and/or a fungicide, commonly known in the industry. The additives are mixed with the solution or individually sprayed on the fibers.

During the drying process or pre-drying 8 process, the fibers are adjusted to a dry substance content which is advantageous to the nonwoven fleece production which follows. This dry substance content ranges preferably between 60-85% of the total weight of the fibers. At this time, the fibers are still flexible and are well conditioned to withstanding mechanical processing. Furthermore, the fibers have a lesser tendency to stick on cards or similar are use in manufacturing nonwoven fleece products. Also, the fibers have, at this moisture content, a limited net weight and therefore are laid as a nonwoven fleece having possible large volume or low density, respectively.

The drying process or pre-drying 8, respectively, is accomplished by applying different drying methods, for instance a whirl dryer, a drum dryer, or a belt dryer.

Basically, it is possible to use the processing steps of mixing 9 with binding fibers, metering in the additives 10, and the drying or pre-drying 8 in a different order. It should be noted that the moving of the fibers in the air flow also has a drying effect and it can be used as such.

As an alternative to the pre-drying 8, it is possible to move the fibers, when completed with the binding fibers and the additives, without the actual pre-drying 8, meaning to comprise a dry substance content of 36-50%, into the nonwoven fleece processing.

Another possible alternative to the pre-drying 8 process is to process the drying of the fibers, prior to the nonwoven fleece manufacturing, to a dry substance content of over 85%.

For the nonwoven fleece lay part, the industry offers different processes, for instance air lay, direct fleece formation 11, spreading, carding, or the like which are suitable for this task.

During the thermal bonding 12 of the fleece (or activating the binding fibers), the heating of the fleece to a mantel component melting temperature of the supporting fibers as well as the setting of the desired panel thickness or density, respectively, takes place. The panel thickness or density, respectively, is set by the above moving belt which compresses the fiber fleece to a thickness of approx. 3 mm to 250 mm and, at the same time, accomplishes a consistent surface. The heating of the fleece takes place through an incoming air temperature of 120-180° C., preferably 140-170° C. The thermal bonding heater is also suitable for the withdrawal of the remaining moisture in the fiber fleece.

After the heating, the fiber fleece is cooled down, cut to the desired size of the fiber mats 13, placed on pallets, and packaged.

Figure 2:
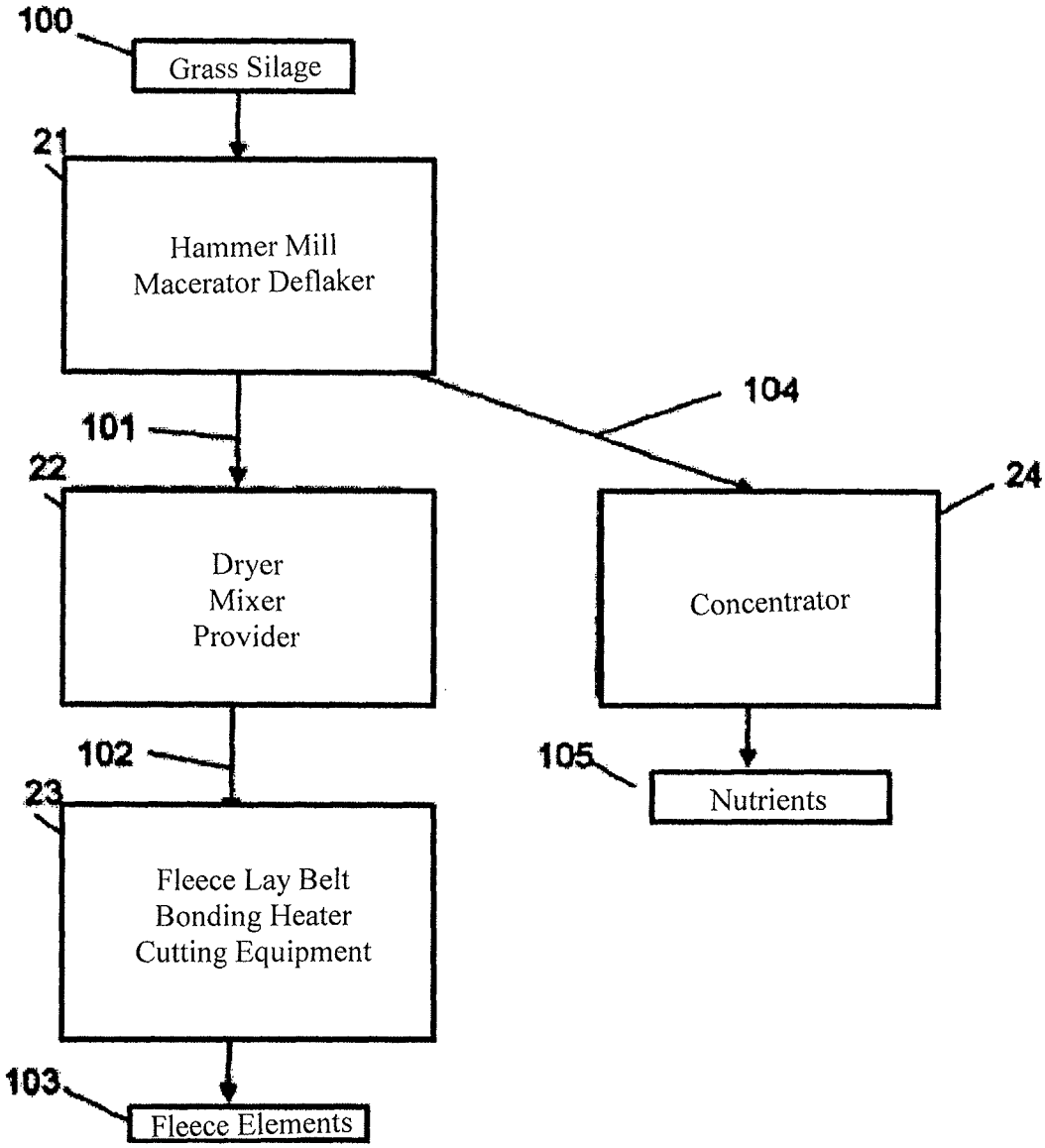
FIG. 2 shows a structure of the system to manufacture nonwoven fleece from grass plants.

FIG. 2 shows the overview of the system for the nonwoven fleece production: a pre-processing unit 21 comprises the fixtures for tearing, de-fibering, and draining, meaning the provision of the plant fibers 101. A core unit 22 comprises the fixtures for mixing 9, spraying 9 of additives and drying 8, and herewith generating the mixture of the fibers 102. A non-woven fleece manufacturing configuration 23 comprises the fixtures for the laying of the fleece, thermal bonding and cutting, to produce the fleece elements 103. An optional concentrate configuration 24 comprises the parts for concentrating the digestible parts 104, which have been separated from the suspension, into nutrients 105.

Fleeces, comprising a density of 25-90 kg/m$^3$, are produced from grass by this inventive method. The panels with lower density are flexible, compressible, and are easily handled. The thermal conductivity was measured at 0.034-0.040 W/(m.K).

For the panels having higher density, the binding fibers are selected in a way so that the product offers an increased mechanical compressive strength, for use as footfall sound isolation as well as directly plastered to outside facades.

Special binding fibers are applied, which influence the material's resetting, when using the fleece for the manufacture of mattresses.

Additional specifications, such as neutrality of odor or water repellency, are achieved through specific treatments of the fibers, for instance by a treatment with oxidation agents or with a hydrophobic agent.

The method allows the use of a raw material, with little exploitation so far in the industry, for the manufacture of a high grade product. Hereby, the facts are being the ecological advantages of the available raw material (re-growing raw material), the use of the product (optimal combination of protection against cold, protection against warmth, and sound isolation), as well as the disposal of the product (Recyclability).

The invention claimed is:

1. A method of manufacturing an insulation mat from a raw material comprising grass plants, the method comprising the steps of:

processing the raw material by forming a raw material suspension and de-fibering the raw material in the raw material suspension and separating digestible content of the raw material from natural fibers of the raw material;

manufacturing a first intermediate product (101) with the natural fibers having which are moist and have a dry substance content of 30% to 50% and a second intermediate product (102) being manufactured from the first intermediate product (101) comprising the steps of:

pre-drying (8) of the natural fibers, adding thermally activatable binding fibers (9) to the natural fibers to form a mixture, and spraying the mixture with at least one additive (10).

2. The method according to claim 1, further comprising the step of using a content by weight of the binding fibers of 4% to 20%.

3. The method according to claim 1, further comprising the step of mixing the binding fibers with the natural fibers (9) so as to have a dry substance content of over 85%.

4. The method according to claim 1, further comprising the step of mixing the binding fibers with the natural fibers (9) so as to have a dry substance content of 40% to 85%.

5. The method according to claim 1, further comprising the step of mixing the binding fibers with the natural fibers (9) in a watery suspension so as to have a dry substance content of under 10%.

6. The method according to claim 1, further comprising the step of pre-drying the natural fibers by exposing the natural fibers to a hot air flow.

7. The method as in claim 1, wherein defibering of the raw material is accomplished through tearing (3), via a hammer mill or a silo-withdrawing shredder, and, in a watery suspension (4) by means of a mechanical defibering system.

8. The method according to claim 7, further comprising the step of using the macerator and the deflaker with a macerator positioned in front of a deflaker.

9. The method according to claim 8, further comprising the step of using grass silage (silage grass) as the raw material (100) which comprises a dry substance content of 20% to 40%.

10. The method according to claim 7, further comprising the step of, after the de-fibering (5), separating the fibers from digestible parts with the digestible parts remaining in the suspension.

11. The method according to claim 10, further comprising the step of concentrating the digestible parts into one of a special feeding stuff or to a nutrient additive (105), and the digestible parts (104) contain mainly acids, proteins and minerals.

12. The method according to claim 11, wherein the digestible parts (104) further comprising at least one of enzymes, vitamins, similar hormone matter and vitamin D3 hormone.

13. The method according to claim 1, further comprising the step of producing an insulation mat from the second intermediate product (102), by the additional steps of:

forming (11) a fleece from the second intermediate product (102), activating (12) of the binding fibers through the heating of the fleece, whereby the binding fibers and natural fibers are bonding together.

14. The method according to claim 13, further comprising the step of forming the second intermediate product (102) so as to comprise a dry substance content of approximately 60% to 85% for manufacture of the fleece, and providing residual drying when heating the fleece in order to activate (12) the binding fibers.

15. The method according to claim 13, further comprising the step of forming the second intermediate product (102) to comprise a dry substance content of approximately 40% to 60%, positioning the second intermediate product (102) on a conveyor belt, post-drying the second intermediate product (102), loosened up the second intermediate product (102), followed by the activation (12) of the binding fibers.

16. The method according to claim 1, further comprising the step of defining the digestible content of the raw material as at least one of lactic acid, acetic acid, amino acid, proteins and minerals.

17. The method according to claim 1, further comprising the step of retaining the digestible content for use as an additive to at least one of animal and human nutrition.

18. A method of manufacturing a non-woven fleece from a natural material, the method comprising the steps of:

reaping the natural material while the natural material is green;

collecting the natural material when the natural material has an approximate dry substance content of between 20-40% by wt;

sealing and storing the natural material airtight such that the natural material retains the approximate dry substance content of between 20-40% by wt;

removing a measure of the natural material from storage;

milling the natural material to reduce a length of the natural material to between 10-30 mm;

manufacturing a first intermediate product from the natural material comprising the steps of:

adding liquid to the natural material to form a natural material suspension;

removing natural fiber from the natural material in the natural material suspension, the natural fibers having a length of between 3-30 mm;

removing the natural fibers from of the natural material by draining liquid soluble and digestible components from the natural material suspension until the natural fibers have a dry substance content of 30-50%;

manufacturing a second intermediate material from the first intermediate product, comprising the steps of:

pre-drying (8) the natural fibers;

adding thermally activatable binding fibers (9) to the natural fibers to form a mixture;

spraying the mixture with at least one additive (10); and forming the non-woven fleece from the second intermediate material and thermally bonding the non-woven fleece.

* * * * *